US006682269B2

(12) United States Patent
Price et al.

(10) Patent No.: US 6,682,269 B2
(45) **Date of Patent: *Jan. 27, 2004**

(54) BLOCK WITH MULTIFACETED BOTTOM SURFACE

(75) Inventors: Gerald P. Price, Rochester, MN (US); Raymond R. Price, Rochester, MN (US)

(73) Assignee: Rockwood Retaining Walls Inc., Rochester, MN (US)

( * ) Notice: Subject to any disclaimer, the term of this patent is extended or adjusted under 35 U.S.C. 154(b) by 98 days.

This patent is subject to a terminal disclaimer.

(21) Appl. No.: 09/811,119

(22) Filed: Mar. 17, 2001

(65) Prior Publication Data

US 2001/0038775 A1 Nov. 8, 2001

Related U.S. Application Data

(63) Continuation-in-part of application No. 09/377,094, filed on Aug. 19, 2001, now Pat. No. 6,250,850.

(51) Int. Cl.[7] ..... E04B 5/04; E04C 2/04

(52) U.S. Cl. ..... 405/284; 52/603; 52/605; 52/606; 52/607; 52/608

(58) Field of Search ..... 405/284; 404/34, 404/41; D25/113; 52/603, 604, 605, 606, 607, 608, 609, 610

(56) References Cited

U.S. PATENT DOCUMENTS 572,762 A * 12/1896 Landers ..... 210/498
D310,267 S * 8/1990 Zeidman ..... D25/113
D311,444 S * 10/1990 Forsberg ..... D25/113
D313,280 S * 12/1990 Rodenburgh et al. ..... D25/113
5,281,048 A * 1/1994 Hagenah ..... 404/44
5,622,456 A * 4/1997 Risi et al. ..... 405/284
5,711,130 A * 1/1998 Shatley ..... 52/604
5,827,015 A * 10/1998 Woolford et al. ..... 405/286
5,943,827 A * 8/1999 Okerlund ..... 52/28
5,984,589 A * 11/1999 Ciccarello ..... 405/284
6,019,550 A * 2/2000 Wrigley et al. ..... 405/262
6,099,942 A * 8/2000 Yakushinji ..... 428/192
6,178,715 B1 * 1/2001 Pacitto et al. ..... 52/604
6,312,197 B1 * 11/2001 Woolford et al. ..... 405/284
D458,693 S * 6/2002 Sievert ..... D25/113

OTHER PUBLICATIONS

"Beautiful Do–It–Yourself Retaining Walls!" Keystone Garden Walls product literature, date unknown, 2 pages.
"Garden Wall" Keystone Retaining Wall Systems product literature, 1991, 3 pages.
"Keystone Intermediate" Keystone Retaining Wall Systems product literature, 1994, 2 pages.

* cited by examiner

*Primary Examiner*—Gary S. Hartmann
(74) *Attorney, Agent, or Firm*—Moore & Hansen

(57) ABSTRACT

A block for use in constructing a retaining wall having a bottom with a non-planar portion which creates a gap between the bottom surface and the top surface of a lower course of similar blocks when the block is placed thereon is herein disclosed. The non-planar portion permits the block to rest on a lower course of blocks and provides a space where small amounts of rubble and dirt may exist without interfering with the stacking of the blocks. The non-planar portion of the block reduces the unit weight of the block without significantly affecting the structural integrity of the block. The block's bottom surface may further comprise a plurality of grooves and a gutter constructed and arranged with respect to the non-planar portion so as to define a bearing surface therebetween.

28 Claims, 5 Drawing Sheets

BLOCK WITH MULTIFACETED BOTTOM SURFACE

CROSS REFERENCES

This application is a continuation in part of U.S. patent application Ser. No. 09/377,094 filed on Aug. 19, 2001, now U.S. Pat. No. 6,250,850.

BACKGROUND OF THE INVENTION

This invention relates generally to the construction of retaining walls used in landscaping applications. Such walls are used to provide lateral support between differing ground levels where the change in one elevation to the other occurs over a relatively short distance, thereby reducing the possibility of erosion and landslides. Retaining walls can be both functional and decorative and range from small gardening applications to large-scale construction. They are constructed of a variety of materials and shapes. Some have been constructed of wood timbers, others of rock in a natural form (such as limestone). Still others have been constructed of manufactured aggregate or concrete blocks. The present invention relates to a manufactured block.

Constructing a fit and true retaining wall can be an arduous endeavor. In addition to laying a level first course on ground which is usually located at the foot or in the side of a steep embankment, the builder must ensure that each subsequent course is level. An error made in a lower course usually gets exaggerated as higher courses are stacked above it. As a wall made of blocks necessarily develops somewhat of a grid-like appearance, interruptions or undulations in the lines of the wall become readily apparent to the human eye.

One particular problem the prior art has failed to overcome is developing a retaining wall block shaped to avoid these undulations and interruptions which are caused by blocks being stacked on dirt or debris found on the upper surface of the lower course of blocks. Dirt presents itself as a result of the fill material used to fill the gap between the rear of the wall and the earth it is being built to retain. This fill material usually consists of small, coarse rocks. They serve as a barrier between the earth and the wall and prevent wet earth from seeping through the bricks of the wall during inclement weather. Present wall building methods include laying a course of blocks, filling the space behind the course with fill material, packing the fill material, and carefully sweeping the dirt off of each completed course prior to the addition of the next course. This final, sweeping step is time consuming but necessary to ensure the next course of blocks lies flat on the lower course.

Some larger blocks incorporate continuous cavities that extend from their bottom surface to their top surfaces. These cavities are intended to reduce the amount of material required to form the block, thereby reducing its cost and weight, and also allow an area to be filled with fill material once a course is finished. At first blush it would appear that, because the presence of cavities reduces the surface area of the top and bottom of the block, they would also serve to decrease the area for interference by small stones and debris between courses. However, because the cavities are filled with fill material, the fill material spills over the upper surfaces and exacerbates, rather than alleviates, the problem. Furthermore, smaller blocks cannot incorporate cavity portions without jeopardizing their structural integrity.

The inability of smaller blocks to accommodate cavity portions creates further problems. Making a solid block out of concrete results in a dense rock which is heavy for its relatively small size. Working with these rocks can become cumbersome. The absence of cavities or interruption in the side walls makes these blocks difficult to lift. They have few areas which lend themselves to easy gripping and lifting. This becomes an important consideration in light of the number of blocks that must be lifted and set in place during the construction of even a relatively small retaining wall.

It would be desirable to develop a retaining wall block shaped to accept a certain amount of dirt and debris from course to course without adversely affecting the overall structure and aesthetics of the resulting wall. It would also be desirable to devise a small retaining wall block which has a reduced unit weight due to the absence of block material in an area that will not adversely affect the strength of the block or its appearance. Finally, it would be desirable to provide a small retaining wall block which is relatively easy to grasp and pick up off of a stack of similar blocks.

These and other objectives and advantages of the invention will appear more fully from the following description, made in conjunction with the accompanying drawings wherein like reference characters refer to the same or similar parts throughout the several views.

SUMMARY OF THE INVENTION

The present invention advantageously provides a block for use in building a retaining wall that produces a level course of blocks, despite the presence of a small amount of debris on the lower course of blocks.

The present invention is also advantageous in that it provides a relatively small block with material removed from strategic locations to provide a block which is lighter than it would have been had it been solid, yet the removal of material has not adversely affected the strength of the block, nor the appearance of the resulting wall.

The present invention advantageously provides a block which has areas for a person building a retaining wall to grasp the block when lifting the block off of a stack of such blocks and placing the block on a lower course of blocks in the wall being constructed.

The instant invention relates to a retaining wall block so shaped that when placed on top of a lower course of similar blocks, it lies flat despite the inevitable presence of dirt, small stones, and other debris. This feature alleviates the time-consuming step of meticulously cleaning the top of each course of blocks before the next course may be laid on top of it.

The block generally comprises a continuous top surface, front and back surfaces extending from the top surface, multi-faceted side surfaces extending from the top surface and spanning from the front surface to perpendicularly intersect the back surface, and a bottom surface having a predetermined surface area that is integral with the front and side surfaces. A gutter is formed into the bottom surface of the block and is spaced away from the rear surface of the block. The gutter formed into the bottom surface of the block preferably has a forward edge that has a minimal surface area that acts to support a rear portion of the block upon a lower course of blocks.

In order to further lighten a block constructed according the present invention, the multifaceted side surfaces of the blocks include an inwardly inset sidewall portion that perpendicularly intersects the rear surface of the block. The multifaceted side surfaces of the block may further comprise a shoulder formed between the aforementioned sidewalls and a forward portion of the multifaceted side surfaces wherein the shoulder and the forward portion of the multifaceted side wall intersect at an obtuse angle.

In order to achieve the tolerance of small stones and debris between courses, a portion of the bottom face of the block of the present invention is non-planar, and more preferably, concave. This concave surface significantly reduces the area for block to block contact between successive courses. Preferably, this non-planar portion covers more than one half of the area of the bottom surface of the block. It also functions to provide an area of clearance or a gap between the stones where debris can migrate without causing interference or instability between courses. The concave portion is preferably shaped to form a portion of a cylinder and extends from one side surface to the other. Alternatively, the concave portion could be shaped to form a portion of a sphere or any other shape.

In addition to the concave portion of the bottom surface, the present invention further comprises a plurality of grooves formed in the bottom surface and preferably extending transversely of the bottom surface between the front and back surfaces. The grooves preferably are angled inwardly to form an inverted "V" shape when the block is given its intended orientation. The grooves allow spaces of increased clearance for larger stones. The grooves preferably comprise two opposed surfaces of a predetermined width extending the length of the groove. The two surfaces are angled to form a "V" shape and meet to form an angle $\alpha$. The angled walls of the grooves not only reduce the weight of the block and act as a splitting aid, but also act to funnel larger stones into the grooves, thereby positioning them into an area of maximum clearance. Alternatively, the first and second surfaces may be joined by a third, curved or flat, surface juxtaposed between the first and second surfaces. Such a third surface would give the groove an inverted "U" shape. The grooves are cut into the block and have a set depth which follows the irregular contour of the non-planar bottom surface.

Preferably, the bottom surface further comprises one or more downward projections proximate the rear surface and having an abutting surface which contacts the rear surface of a lower course of blocks when the block is stacked thereon. It is envisioned that the abutting surface is either parallel to the rear surface of the block, or forms an angle $\beta$ with the rear surface. These projections create an automatic and uniform setback among successive courses of blocks so that the resulting retaining wall is angled rearwardly. This also adds resistive strength to the wall against the natural forces exerted on the wall by the earth the wall is retaining by tying successive courses of blocks into those course below them. Preferably, the downward projection has a generally trapezoidal cross-sectional shape and is spaced away from the rear surface of the block. In addition, the abutting surface of the downward projection is preferably integral with a rear face of the gutter.

DETAILED DESCRIPTION

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined only by the claims.

Figure 1:
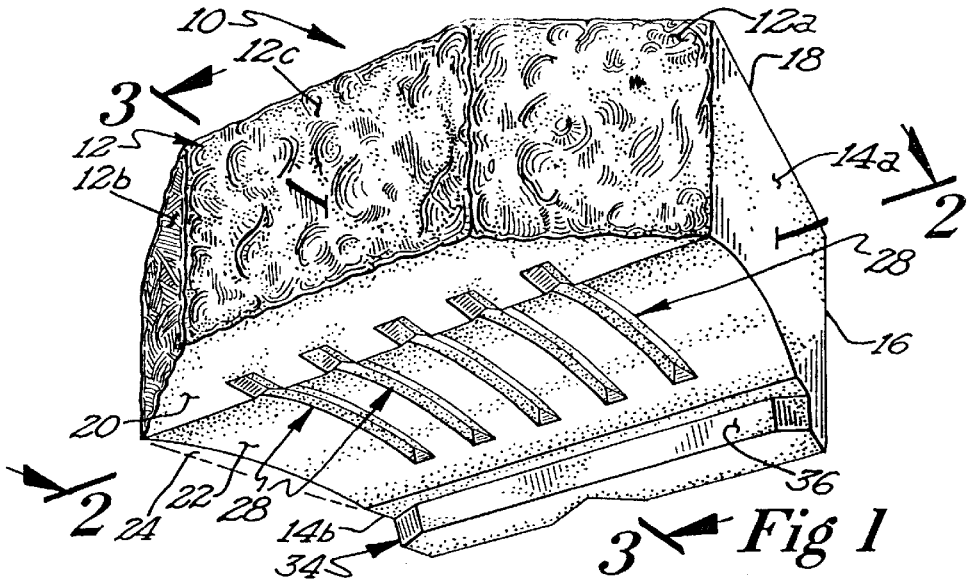
FIG. 1 is a perspective view of a block of the present invention, looking up at the bottom to reveal the details of the bottom surface.

Referring now to FIG. 1, there is shown a retaining wall block 10 having a front surface 12, side surfaces 14*a* and 14*b* extending rearwardly from front surface 12 and integral with rear surface 16. Top surface 18 is generally planar and continuous across its extents. Top surface 18 extends from side surface 14*a* to side surface 14*b*, and from front surface 12 to rear surface 16. Preferably, top surface 18 is generally perpendicular to side surfaces 14*a* and 14*b*, and also to front surface 12 and rear surface 16.

In the embodiment shown in FIGS. 1–9, front surface 12 comprises three parts, 12*a*, 12*b*, and 12*c*. Part 12*c* is generally parallel to rear surface 16 and lies between parts 12*a* and 12*b*. Parts 12*a* and 12*b* are angled such that the extend from part 12*c* and diverge rearwardly to meet side surfaces 14*a* and 14*b*, respectively. Parts 12*a*, 12*b*, and 12*c* are shown as split faces as opposed to formed faces. Creating a face with a rock splitter results in an irregular, more natural appearing surface. Also shown in the Figures is a rear surface 16 which has a smaller width than front surface 12 such that side surface 14*a* and 14*b* must converge rearwardly in order to be integral with rear surface 16. This shape allows the construction of straight, concave, convex, or serpentine walls without interrupting the relatively uniform appearance created by the front surfaces 12 of a plurality of blocks 10 forming a wall.

Figure 3:
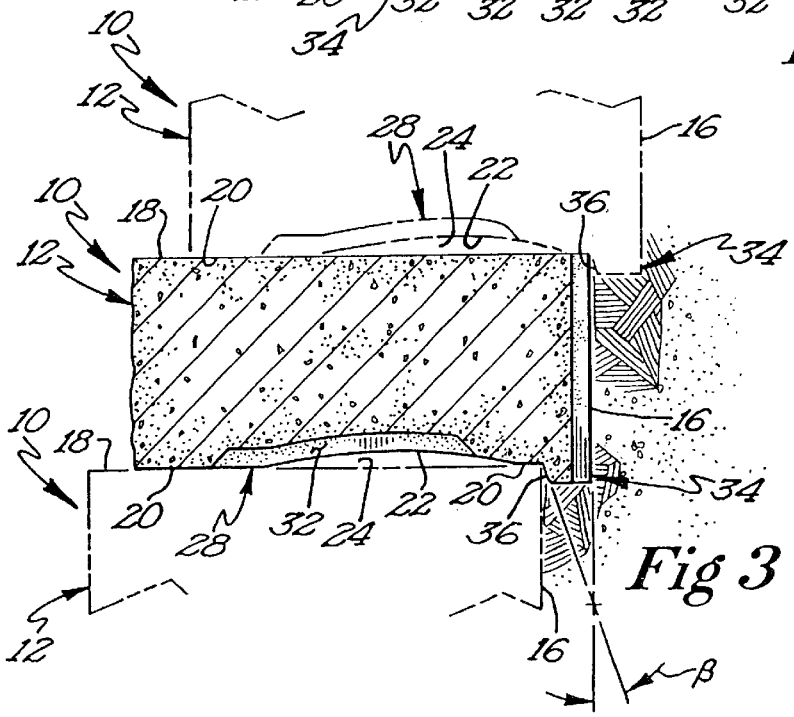
FIG. 3 is a cross sectional view of the block of the present invention taken along lines 3—3 of FIG. 1 and shown with other blocks in phantom, stacked, as in a retaining wall.
Figure 4:
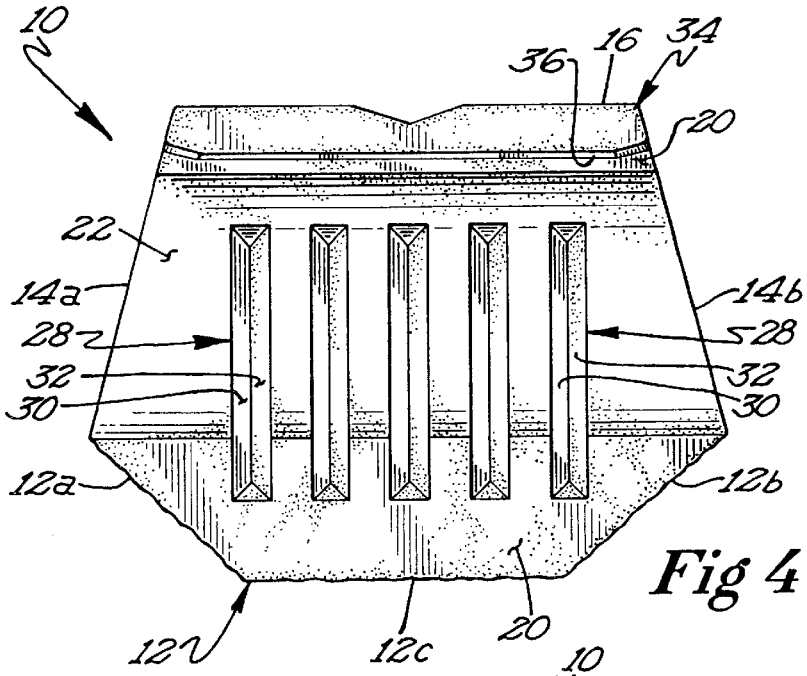
FIG. 4 is a bottom plan view of the block of FIG. 1.
Figure 5:
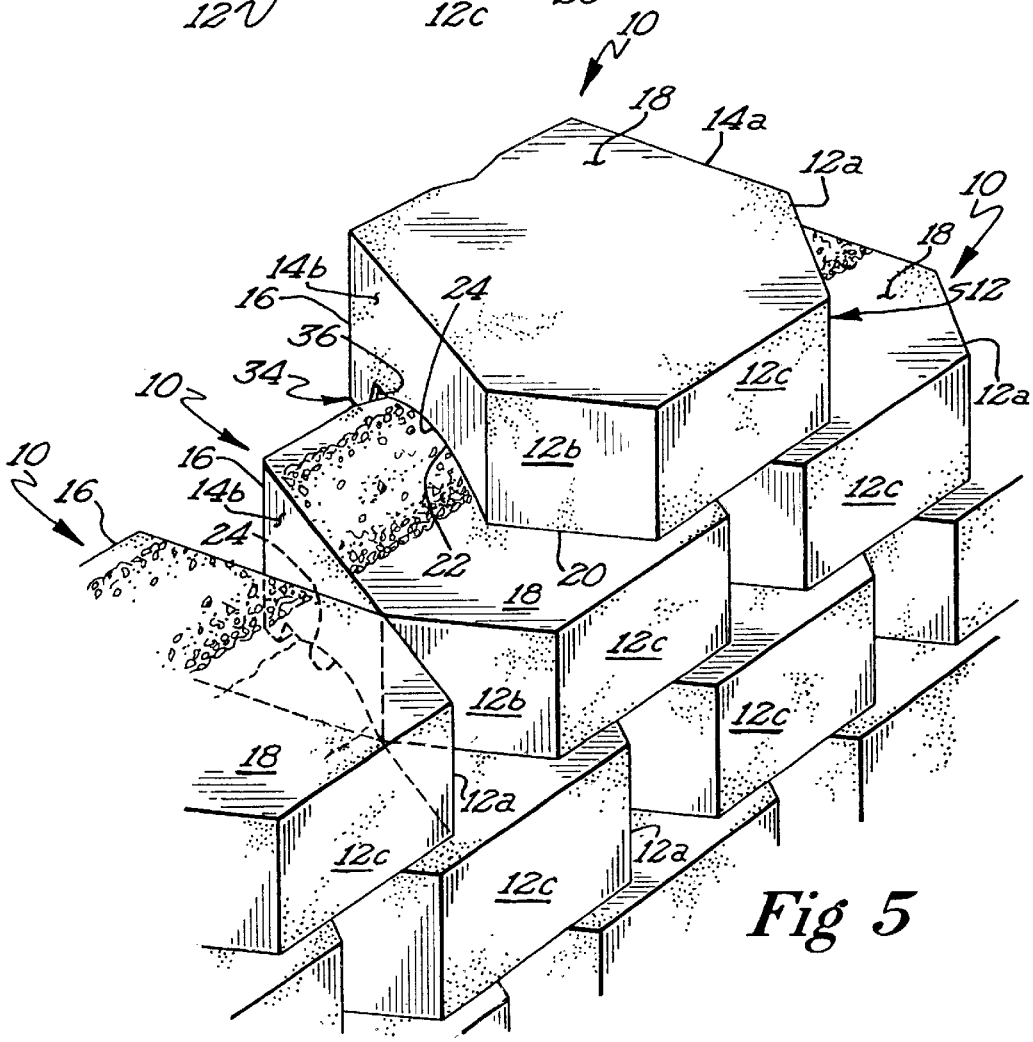
FIG. 5 is a perspective view of the block shown in FIG. 1 in a stacked relationship with other blocks, as in a wall, and showing debris resting on a lower course of blocks and accommodated for by the concave area of the bottom surface of the block of the present invention.

Bottom surface 20 extends from front surface 12 to rear surface 16 and from side surface 14*a* to side surface 14*b*. Bottom surface 20 includes concave, or non-planar portion 22. Concave portion 22 is depicted in FIGS. 1, 3 and 4 as a relatively cylindrical indentation in bottom surface 20, extending from side surface 14*a* to side surface 14*b*. Preferably, portion 22 does not extend forward of where side surfaces 14*a* and 14*b* meet parts 12*a* and 12*b* of front surface 12. This way concave portion 22 is not visible in a completed wall, regardless of whether the wall is straight, concave, convex, or serpentine.

Allowing concave portion 22 to extend from side surface 14*a* to side surface 14*b* creates a gap 24 between the bottom surface 20 and the upper surface of a lower course of blocks when block 10 is placed thereon. This gap 24 may be used for ease in picking the block up and setting the block down. Also, as shown in FIGS. 1, 3 and 4, concave portion 22 extends rearwardly but ends forward of downward projection 34, which is described in more detail below. Ending the concave or, non-planar portion 22 forward of downward projection 34 provides another flat surface for block to block contact to assist in the leveling and stabilization of block 10 on a lower course of blocks.

Alternatively, it is envisioned that concave portion 22 be an indentation of any shape, such as the generally spherical shape of the embodiment shown in FIGS. 6–9. Preferably, portion 22 is large enough to occupy at least 30 percent, more preferably on the order of 50 to 75 percent, of the surface area of bottom surface 20.

Figure 2:
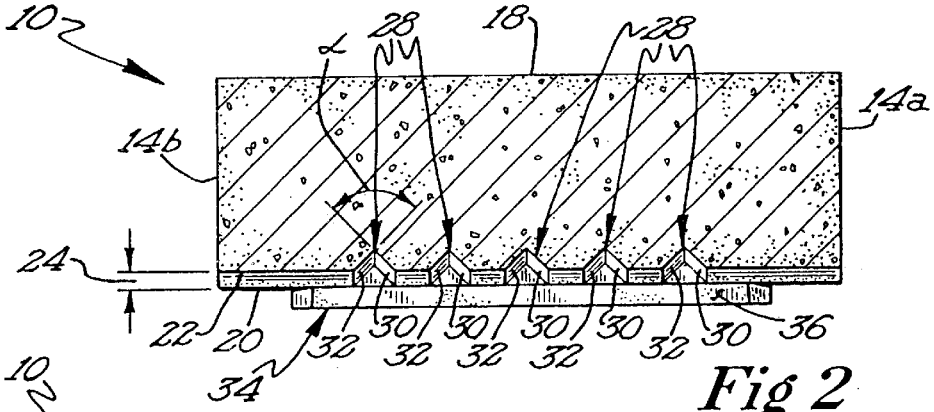
FIG. 2 is a cross sectional view of the block of the present invention taken along lines 2—2 of FIG. 1.

In one embodiment, bottom surface 20 also includes at least one, preferably a plurality of, grooves 28. As shown in FIG. 2, grooves 28 are preferably "V"-shaped and extend from the bottom surface into the block toward top surface 18. In the embodiment depicted in FIGS. 1 and 2, grooves 28 are spaced generally equidistant from each other and oriented such that they extend from front to back generally across the non-planar portion 22. It is envisioned that grooves 28 could be located generally anywhere across bottom surface 20. It is preferred, however, that grooves 28 do not intersect front surface 12 so that grooves 28 remain hidden from view when block 10 is part of a completed wall.

Figure 7:
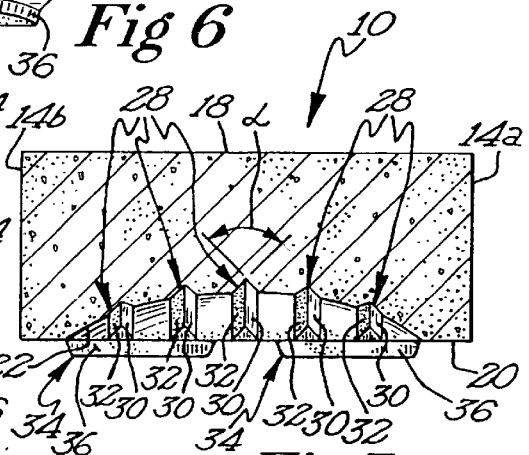
FIG. 7 is a sectional elevational view taken along lines 7—7 of FIG. 6.

Grooves 28 having the preferred "V" shape generally comprise at least a first surface 30 and a second surface 32. First surface 30 extends from bottom surface 20 and is integral with second surface 32. Second surface 32 extends from first surface 30 to bottom surface 20 thereby forming an angle $\alpha$ between first surface 30 and second surface 32 as seen in FIGS. 2 and 7. Angle $\alpha$ is preferably less than 180 degrees. Alternatively, first surface 30 and second surface 32 could be joined by a third surface (not shown in the Figures) which extends along the length of the groove and is juxtapose between the first and second surfaces. This third surface could be curved, thereby forming a "U" shaped groove, or the third surface could be flat, thereby forming a rectangular groove. However, a "V" shaped groove generally eases manufacturing.

Figure 6:
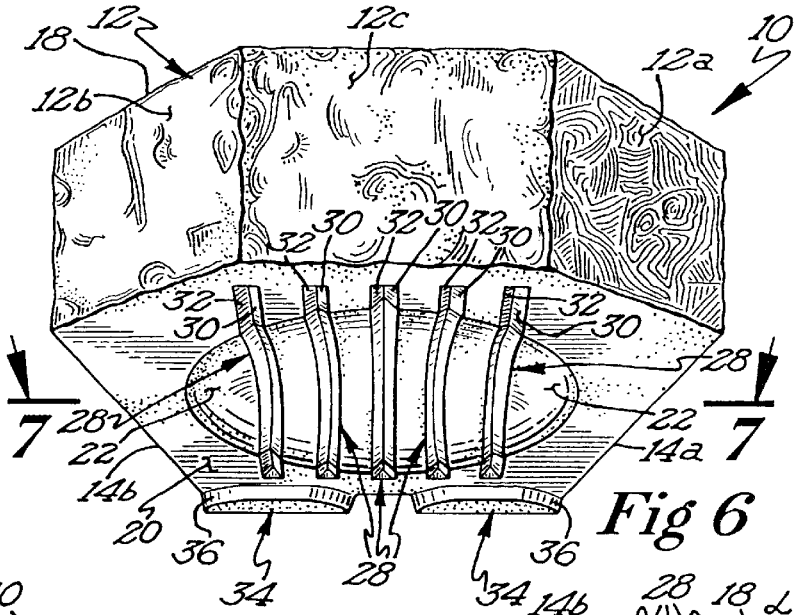
FIG. 6 is a perspective view of an alternative embodiment of the present invention, looking up at the bottom to show the detail of the bottom surface.
Figure 8:
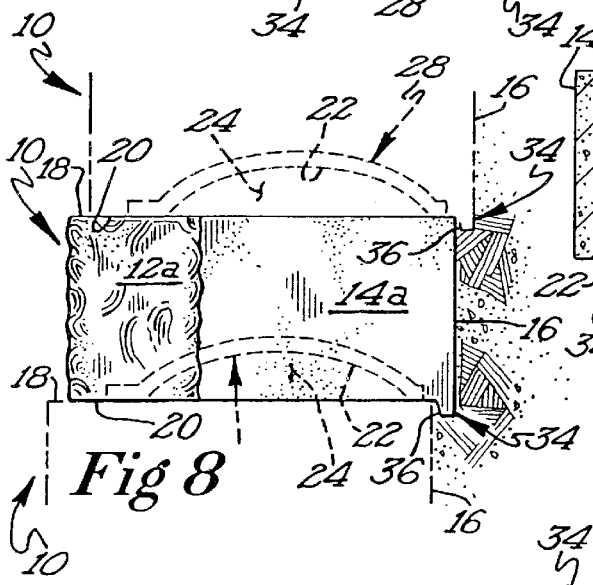
FIG. 8 is an end elevational view of a block of the embodiment shown in FIG. 6, in stacked relation, as in a wall, with other blocks shown in phantom.
Figure 9:
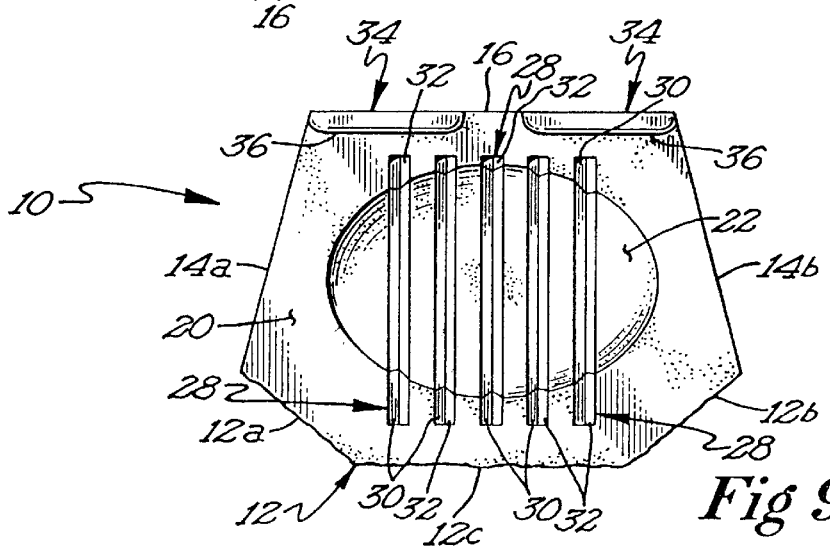
FIG. 9 is a bottom plan view of a block of the embodiment shown in FIG. 6.

As shown in all Figures, bottom surface 20 also includes at least one downward projection 34. Downward projection 34 may extend across bottom surface 20, adjacent rear surface 16 as shown in FIGS. 1, 2, and 4. Alternatively, projection 34 may be broken into more than one projection 34 as shown in FIGS. 6, 7 and 9. Projection 34 has an abutting surface 36 which is used to abut against the rear surface 16 of a lower course of blocks, thereby forming a setback between successive courses of blocks. This setback add strength and stability to the resulting wall.

Abutting surface 36 may be substantially parallel to rear surface 16. Alternatively, for ease of manufacture, abutting surface 36 may angle rearwardly forming a relatively small angle $\beta$ with rear surface 16 as shown in FIG. 3. Angle $\beta$ is preferably less than 45 degrees, more preferably less than 30 degrees. A smaller angle $\beta$ provides more resistance to horizontal block slippage due to external forces against the back of the resulting wall.

Referring now to FIGS. 10–16, there is shown a preferred embodiment of a retaining wall block 50 having a front surface 52, side surfaces 54*a* and 54*b* extending rearwardly from front surface 52 toward rear surface 56. Top surface 58 is generally planar and continuous across its extents. Top surface 58 extends from side surface 54*a* to side surface 54*b*, and from front surface 52 to rear surface 56. Preferably, top surface 58 is generally perpendicular to side surfaces 54*a* and 54*b*, and also to front surface 52 and rear surface 56.

In the embodiment shown in FIGS. 10–16, front surface 52 comprises three parts, 52*a*, 52*b*, and 52*c*. In general, these parts will referred to as the front surface parts or as the face of the block 50. Part 52*c* is generally parallel to rear surface 56 and lies between parts 52*a* and 52*b*. Parts 52*a* and 52*b* are angled such that they extend from part 52*c* and diverge rearwardly to meet side surfaces 54*a* and 54*b*, respectively. Parts 52*a*, 52*b*, and 52*c* are in FIGS. 10–16 shown as formed with split faces as opposed to smooth faces. Block 50 may preferably be formed by splitting as described above in conjunction with FIGS. 1–9. Creating a face with a rock splitter results in an irregular, more natural appearing surface. As can be seen in the Figures, rear surface 56 has a smaller width than front surface 52. Side surfaces 54*a* and 54*b* converge rearwardly toward the rear surface 56 at obtuse angle to the rear surface 56. This shape allows the construction of straight, concave, convex, or serpentine walls without interrupting the relatively uniform appearance created by the front surfaces 52 of a plurality of blocks 10 forming a wall.

Block 50 has a heel portion 70 that comprises the rear surface 56, a projection 72 and a gutter 74. As can be seen most clearly in FIGS. 10 and 13, sides 54*a* and 54*b* incorporate shoulders 76*a* and 76*b*, respectively. Shoulders 76 may also be seen as a forward boundary of the heel portion 70 of the block 50. Note that shoulders 76 form an obtuse angle with respect to sides 54. Heel portion side walls 78*a* and 78*b* extend rearwardly from respective shoulders 76*a* and 76*b* and intersect with rear surface 56 of block 50. Heel portion side walls 78*a* and 78*b* are preferably formed perpendicular to shoulders 76*a* and 76*b* and to rear surface 56 of block 50. The resulting sides 54 comprise multiple facets and provide a number of benefits. Formation of side walls 78*a* and 78*b* as illustrated in the Figures results in a lighter block 50 as the block 50 will have a smaller volume. As a corollary benefit, less concrete material is used in the formation of block 50 where side walls 78*a* and 78*b* are formed as indicated.

Bottom surface 60 extends from front surface 52 to gutter 74 and from side surface 54*a* to side surface 54*b*. Bottom surface 60 includes concave, or non-planar portion 62. Concave portion 62 is depicted in FIGS. 11, 12, 15, and 16 as a relatively cylindrical indentation in bottom surface 60, extending from side surface 54*a* to side surface 54*b*. Preferably, portion 62 does not extend forward of where side surfaces 54*a* and 54*b* meet parts 52*a* and 52*b* of front surface 52. In this way concave portion 62 will not be visible in a completed wall, regardless of whether the wall is straight, concave, convex, or serpentine.

Allowing concave portion 62 to extend from side surface 54*a* to side surface 54*b* creates a gap 64 between the bottom surface 60 and the upper surface of a lower course of blocks when block 50 is placed thereon. This gap 64 may be used for ease in picking the block 50 up and setting the block down. As can be seen in FIGS. 11, 12, 15, and 16, gap 64 extends all the way to the edge 75 of gutter 74. Because gap 64 extends all the way to edge 75 of gutter 74, a block 50 in an upper course of blocks will rest upon a block 50 in a lower course of blocks upon that portion of bottom surface 60 that extends between the front face parts 52*a*, 52*b*, and 52*c* and the forward edge 63 of the concave portion 62 and the edge 75 of gutter 74. As can be appreciated, the rear of the block 50 is supported only on edge 75 and not on a planar surface, i.e. edge 75, while having any number of curvilinear and/or rectilinear shapes, has a small surface area with respect to the remainder of bottom surface 60. This affords the benefits of increased friction between two courses of blocks 50 and prevents the entrapment of sand, gravel, or bits of concrete between the upper surface 58 of a lower course of blocks and the bottom surface 60 of an upper course of blocks.

Gutter 74 extends upwardly from edge 75 into the body of block 50 toward the top surface 58. Gutter 74 extends laterally between heel portion side walls 78*a* and 78*b* and has a generally "U" shaped cross-sectional area. Note that the exact cross-sectional shape of the gutter 76 may vary. However it is important to form the gutter 74 without sharp-edged concave surfaces. Therefore, the cross-sectional shape of the gutter 74 will be gently curved within the constraints of its position and size. Such a shape avoids the formation of unwanted stress concentration points that might facilitate the fracture of the block.

The rear face of the gutter 74 extends downwardly, away from the top surface of block 50 and beyond edge 75 to form an abutting surface 80 of projection 72. Projection 72 and its abutting surface 80 function in the same manner as projection 34 and its abutting surface 36, described above. That is, projection 72 acts to rearwardly offset each course of blocks 50 from the lower course upon which the upper course of blocks 50 rest. Projection 72 is preferably offset forwardly from the rear surface 56. As can be seen in the Figures, rear face 82 of projection 72 is moved forward of the rear surface 56 of the block 50. Additionally, it is preferred to cant the rear face 82 of projection 72 forwardly so that the projection has a generally trapezoidal cross-sectional shape with radiused edges. While this trapezoidal shape is not the only shape that may be used, it does afford additional durability to the projection 72 in that the lack of sharp edges prevents chipping and fracture of the projection 72. The trapezoidal shape of the abutting surface 80 of the projection 72 aids in the rapid construction of walls by preventing the entrapment of sand, gravel, or pieces of concrete between the abutting surface 80 of the projection 72 of a block 50 in an upper course and the rear surface 56 a block 50 in a lower course.

The formation of a heel structure 70 such as that illustrated in FIGS. 10–16 has the additional benefit of strengthening the projection 72 by forcing more of the concrete from which the blocks 50 are formed into the area of the mold that forms the projection 72. Projection 72 of block 50 therefore has fewer voids, is more dense and is consequently stronger.

Figure 10:
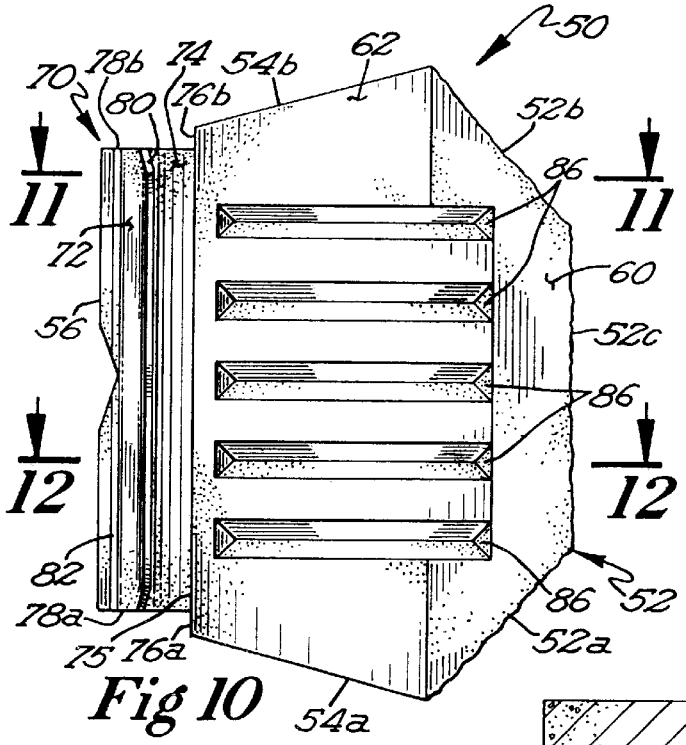
FIG. 10 is a bottom plan view of a block of the present invention.
Figure 11:
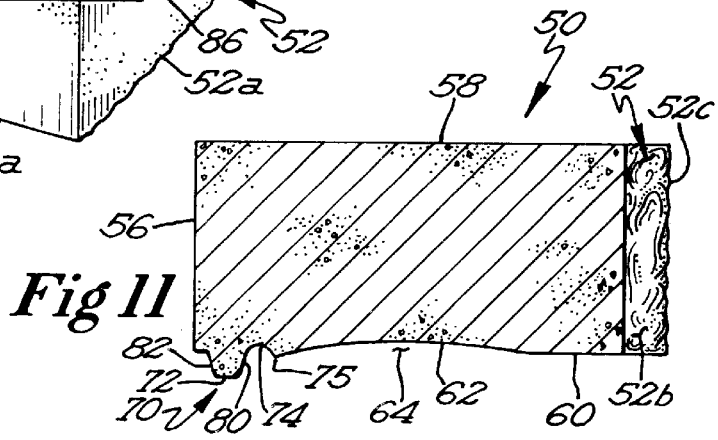
FIG. 11 is a cross-sectional view of the block of FIG. 10 taken along cutting lines 11—11 in FIG. 10.
Figure 12:
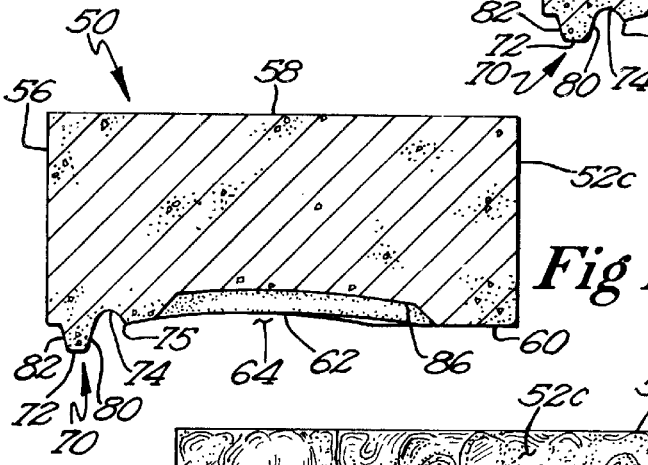
FIG. 12 is a cross-sectional view of the block of FIG. 10 taken along cutting lines 12—12 in FIG. 10.
Figure 14:
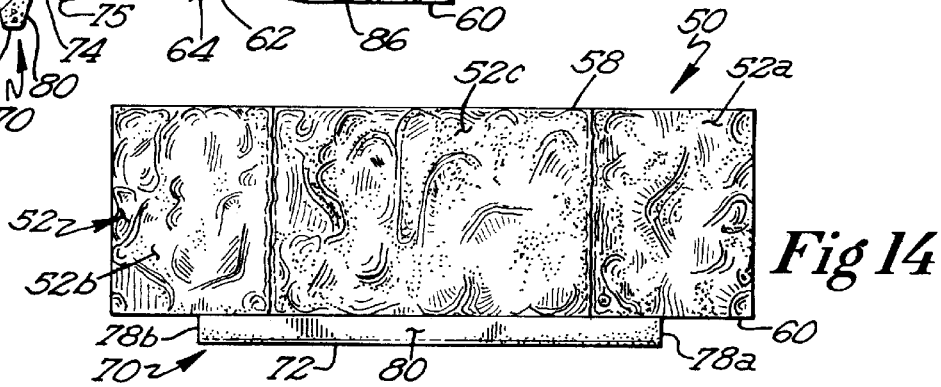
FIG. 14 is a front elevational view of the block of FIG. 10.
Figure 13:
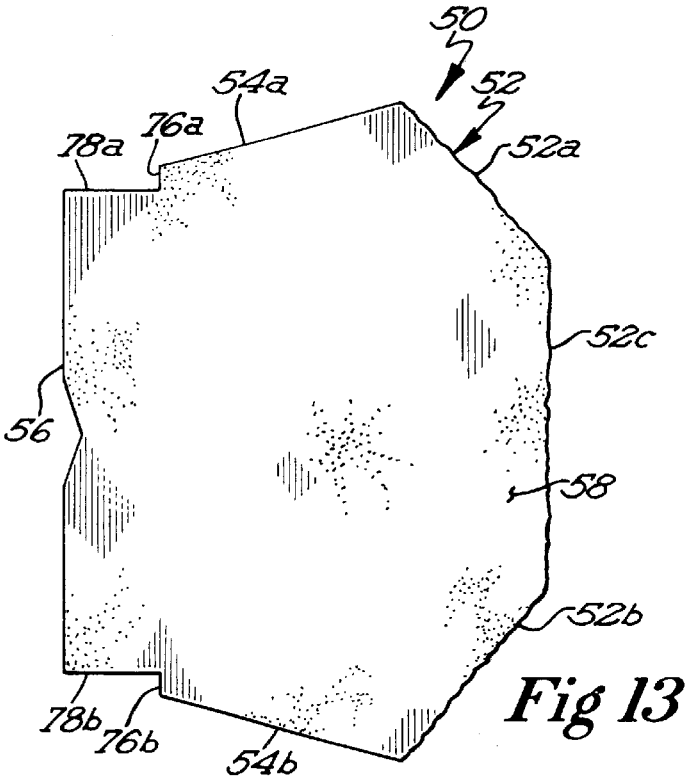
FIG. 13 is a top plan view of the block of FIG. 10.
Figure 15:
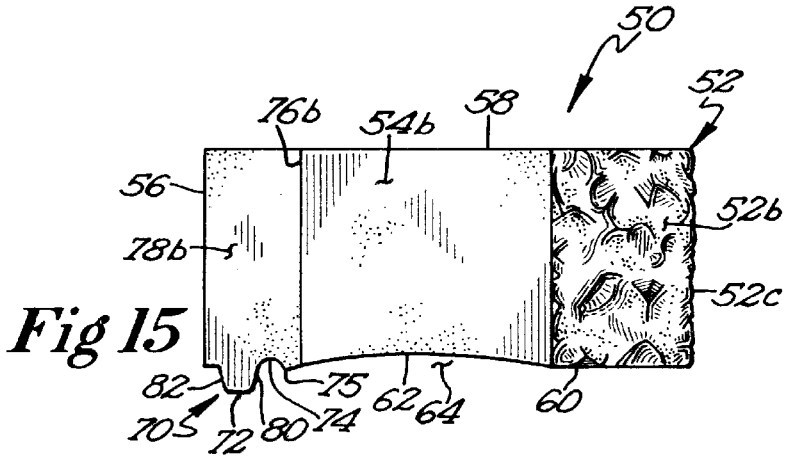
FIG. 15 is a side elevational view of a first side of the block of FIG. 10; and, FIG. 16 is a side elevation view of a second side of the block of FIG. 10.
Figure 16:
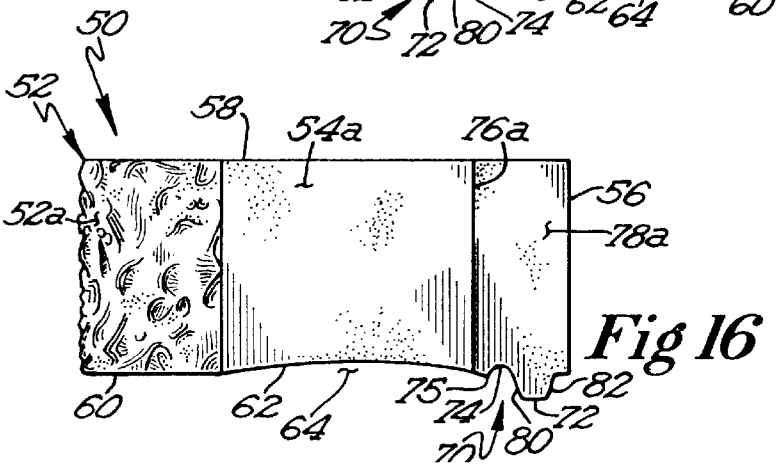

In the preferred embodiment, bottom surface 60 also includes at least one, and preferably a plurality of, grooves 86 that are similar in shape and disposition to the grooves 28 described above in conjunction with FIGS. 1 and 2. Grooves 86 preferably have the "V"-shape as described above. While the grooves 86 may be located generally anywhere across the bottom surface 60, it is preferred to locate the grooves substantially within the curved portion 62 of the bottom surface 60. As seen in FIG. 10, grooves 68 may extend from front to back from a position on surface 60 somewhat forward of the point where front surfaces 52*a* and 52*b* interest side surfaces 54*a* and 54*b*, respectively, to a position just forward of edge 75 of gutter 74. Care must be taken to space the grooves 86 away from edge 75 sufficiently to avoid weakening edge 75. Grooves 86 not only result in a lighter block 50, but also realize a cost savings in the use of less concrete to form the blocks 50. Additionally, grooves 86 may aid installers in the field by providing a fracture line along with the block 50 may be broken to fill a gap in wall made from blocks 50.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A block for constructing a retaining wall comprising:

a generally planar top surface;

front and back surfaces extending from the top surface;

multi-faceted side surfaces extending from the top surface and spanning from the front surface to the back surface;

a bottom surface having a predetermined surface area and integral with the front and side surfaces, and having a concave portion, the concave portion creating a cavity between the bottom surface of the block and a top surface of a lower course of blocks when the block is placed on the top surface of the lower course of blocks, the cavity allowing a limited amount of dirt and other foreign matter to exist between successive courses of blocks without creating instability between the block and the lower course of blocks; and, a gutter formed into the bottom surface of the block and spaced away from the rear surface of the block, the gutter extending into the block through the bottom surface thereof so as to define a bearing surface in the bottom surface of the block between the concave portion of the bottom surface and the gutter.

2. The block of claim 1 wherein the concave portion accounts for greater than one half of the total surface area of the bottom.

3. The block of claim 1 further comprising at least one groove formed in the concave portion of the bottom surface.

4. The block of claim 1 wherein said concave portion is shaped to substantially form a portion of a cylinder.

5. The block of claim 4 wherein said concave portion extends from one of said multi-faceted side surfaces to the other multi-faceted side surface.

6. The block of claim 1 wherein said concave portion is shaped to substantially form a segment of a sphere having a generally circular edge defined on said bottom surface.

7. The block of claim 1 further comprising a plurality of elongate grooves formed in the bottom surface.

8. The block of claim 7 wherein the elongate grooves extend transversely of the bottom surface between the front and the back surfaces.

9. The block of claim 7 wherein each of the plurality of grooves further comprise:

a first surface and a second surface;

the first surface extending along the length of said groove and connecting said bottom surface with the second surface;

the second surface extending along the length of said groove and connecting said bottom surface with the first surface and forming an angle $\alpha$ between the first surface and the second surface, said angle $\alpha$ having a value of less than 180 degrees.

10. The block of claim 9 wherein said angle $\alpha$ has a value between 120 degrees and 60 degrees.

11. The block of claim 7 wherein each of the plurality of grooves further comprise: a first surface, a second surface and a third surface;

the first surface extending along the length of said groove and connecting said bottom surface with the third surface;

the second surface extending along the length of said groove and connecting said bottom surface with the third surface;

the third surface extending along the length of said groove, connecting the first surface with the second surface and upwardly displaced from the bottom surface.

12. The block of claim 1 wherein said bottom surface further comprises:

at least one downward projection formed between the rear surface and the gutter formed into the bottom surface of the block, said downward projection having an abutting surface which contacts the rear surface of a lower course of blocks when the block is stacked thereon, thereby causing the block to be set rearwardly of the lower course of blocks.

13. The block of claim 12 wherein the abutting surface of said downward projection forms an angle β with the rear surface which is less than 45 degrees.

14. The block of claim 12 wherein the abutting surface of said downward projection forms an angle β with the rear surface which is less than 30 degrees.

15. The block of claim 12 wherein the downward projection has a generally trapezoidal cross-sectional shape.

16. The block of claim 12 wherein the downward projection is spaced away from the rear surface of the block.

17. The block of claim 12 wherein the abutting surface of the downward projection is integral with a rear face of the gutter.

18. The block of claim 12 wherein the abutting surface of said downward projection is generally angled toward the rear surface.

19. The block of claim 1 wherein the bearing surface between the concave portion and the gutter is narrower than the width of the gutter.

20. The block of claim 19 wherein a forward edge of the gutter supports a rear portion of the block upon a lower course of blocks.

21. The block of claim 1 wherein the multi-faceted sides perpendicularly intersect the rear surface of the block.

22. The block of claim 1 wherein the multifaceted side surfaces further comprise an inwardly inset sidewall portion that perpendicularly intersects the rear surface of the block.

23. The block of claim 22 wherein the multifaceted side surfaces further comprise a shoulder formed between the sidewalls and a forward portion of the multifaceted side surfaces, the shoulder and the forward portion of the multifaceted side wall intersecting at an obtuse angle.

24. A block for use in constructing a retaining wall comprising:

a top surface;

a bottom surface, the bottom surface having a non-planar portion which creates a vertical gap between the bottom surface and a top surface of a lower course of blocks when said block is placed thereon in the construction of the wall;

a front surface extending vertically from the top surface to the bottom surface;

multifaceted side surfaces extending vertically from the top surface to the bottom surface and rearwardly from the front surface; and, a heel portion comprising a rear surface that extends vertically between the top surface and the bottom surface and horizontally between the multifaceted side surfaces, the heel portion having formed into the bottom surface thereof a gutter that extends upwardly into the block toward the top surface thereof and a downwardly depending projection that extends from the bottom surface of the heel portion of the block, the downwardly depending projection being spaced away from the rear surface of the heel portion.

25. The block of claim 24 wherein the multifaceted side surfaces perpendicularly intersect the rear surface of the heel portion.

26. The block of claim 24 wherein the multifaceted side surfaces further comprise an inwardly inset sidewall portion that perpendicularly intersects the rear surface of the heel portion.

27. The block of claim 26 wherein the multifaceted side surfaces further comprise a shoulder formed between the sidewalls and a forward portion of the multifaceted side surfaces, the shoulder and the forward portion of the multifaceted side wall intersecting at an obtuse angle.

28. The block of claim 24 wherein the gutter of the heel portion is formed immediately adjacent the non-planar portion of the bottom surface of the block so as to form an edge therebetween.

* * * * *

UNITED STATES PATENT AND TRADEMARK OFFICE

CERTIFICATE OF CORRECTION

PATENT NO. : 6,682,269 B2 
DATED : January 27, 2004
INVENTOR(S) : Gerald P. Price and Raymond R. Price It is certified that error appears in the above-identified patent and that said Letters Patent is hereby corrected as shown below:

Title page,
Item [63], Related Application Data, delete "Aug. 19, 2001" and insert therefor -- Aug. 19, 1999 --.

Signed and Sealed this

Seventh Day of September, 2004

JON W. DUDAS
*Acting Director of the United States Patent and Trademark Office*